US007322329B2

(12) United States Patent
Hendriksma et al.

(10) Patent No.: US 7,322,329 B2
(45) Date of Patent: Jan. 29, 2008

(54) ASSEMBLY PROCESS FOR HYDRAULIC VALVE LIFTERS TO REDUCE VARIATION IN VALVE LIFT

(75) Inventors: Nick J. Hendriksma, Grand Rapids, MI (US); David Draeger, Byron Center, MI (US)

(73) Assignee: Delphi Technologies, Inc., Troy, MI (US)

( * ) Notice: Subject to any disclaimer, the term of this patent is extended or adjusted under 35 U.S.C. 154(b) by 55 days.

(21) Appl. No.: 11/372,926

(22) Filed: Mar. 10, 2006

(65) Prior Publication Data

US 2007/0209617 A1 Sep. 13, 2007

(51) Int. Cl.
*F01L 1/14* (2006.01)

(52) U.S. Cl. ..... 123/90.52; 123/90.48; 123/90.55

(58) Field of Classification Search ..... 123/90.39, 123/90.44, 90.48, 90.5, 90.52, 90.55; 74/567, 74/569

See application file for complete search history.

(56) References Cited

U.S. PATENT DOCUMENTS 6,814,040 B2 11/2004 Hendriksma et al.
7,089,900 B2 * 8/2006 Masello et al. ..... 123/90.45

* cited by examiner

*Primary Examiner*—Ching Chang
(74) *Attorney, Agent, or Firm*—Paul L. Marshall

(57) ABSTRACT

Valve lift variation associated with a deactivation roller hydraulic valve DRVHL (DRHVL) can result in unacceptable valve overlap and idle conditions for an internal combustion engine. Two sources of length variation in a DRHVL are leakdown and residual mechanical lash. Total length variation is the sum of these two factors, and each factor has an associated tolerance. In the prior art, the two factors are independent, resulting in a total population variation that is the sum of the two independent variations. A DRHVL assembly process in accordance with the invention includes the step of associating leakdown test results for individual lash adjusters with residual lash results by adjusting the residual lash characteristics of individual DRHVL assemblies to complement the leakdown characteristics in minimizing total length variation in the population of assembled DRHVLs.

9 Claims, 6 Drawing Sheets

ASSEMBLY PROCESS FOR HYDRAULIC VALVE LIFTERS TO REDUCE VARIATION IN VALVE LIFT

TECHNICAL FIELD

The present invention relates to a valve-deactivation roller hydraulic valve lifter (DRVHL) for internal combustion engines; more particularly, to processes for assembling DRHVLs; and most particularly, to a selective assembly process for DRHVLs wherein the leakdown characteristics of a population of subassemblies are matched to the mechanical lash characteristics of the same population of subassemblies to provide a population of finished DRHVLs having reduced variation in valve overlap between an intake and exhaust valve of a particular cylinder.

BACKGROUND OF THE INVENTION

DRHVLs for internal combustion engines are well known as elements of valve trains disposed between a valve stem or pushrod and an associated engine cam, whereby the engine valve associated with the DRHVL may be selectively activated and deactivated.

The hydraulic lash compensation mechanism of such lifters is similar to the hydraulic compensation mechanism of a conventional lifter. As known in the art, the hydraulic lash compensation mechanism is used to take up lash in the valve train and includes a piston and a plunger defining a low pressure oil chamber and a high pressure oil chamber separated by a one-way check valve that limits the flow of oil from the high pressure to low pressure chambers when the associated valve is open. Oil flow from the low to high pressure chambers is otherwise permitted. Thus, the lifer is hydraulically rigid against the check valve and competent to open the associated valve and, by accepting oil into the high pressure chamber through the check valve, can extend the operating length of the lifter to remove the accumulated mechanical lash in a valve train while the lifter is on the base circle portion of an associated cam lobe (and thereby eliminating valve clatter and quieting engine operation).

The hydraulic lash compensation mechanism described above must also have the capability to shorten the operating length of the lifter in response to thermally induced dimensional changes in engine components. Thus, in addition to being able to extend the operating length of the lifter as previously described, every lifter must also have the capability of bleeding oil from the high pressure chamber to reduce the operating length of the lifter. As this cannot be done via the check valve, typically a designed-in radial clearance is provided between the wall of the lash compensation mechanism and the surrounding body wall to permit a controlled "leakdown" of oil from the high pressure chamber back to the oil sump of the engine.

The rate of leakdown significantly impacts the amount of valve overlap provided in a combustion cycle. Valve overlap occurs when both the intake and exhaust valve are open within a given cylinder at the same time. Controlling the leakdown and valve overlap is critical because exhaust gas flows from the exhaust system into the intake manifold during the overlap period. The cross-flow of exhaust gas is known in the art as internal exhaust gas recirculation (EGR). Too low of a leakdown rate in an exhaust valve lifter will cause the associated valve to have an increased net lift and a later closing causing greater valve overlap between the opening event of the intake valve and the closing event of the exhaust valve of the same cylinder. The increase in the amount of internal EGR caused by greater valve overlap leads to combustion instability, manifesting as a rough idle. Too high of a leakdown rate in an exhaust valve lifter will cause the valve to have a decreased net lift and an earlier closing causing lesser valve overlap in the associated cylinder and a decreased amount of internal EGR. Leakdown rate variation may occurs both in an intake valve lifter and an exhaust valve lifter. However, since the effect of leakdown in a valve lifter accumulates over the entire lift event, the amount of leakdown when the intake valve is just opening (when valve overlap would occur) and its contribution to varying valve overlap is negligible.

In a DRHVL, the hydraulic lash compensation mechanism resides, slidably, in a bore of the DRHL's locking pin plunger member as shown in FIG. 6 of U.S. Pat. No. 6,814,040. In the case of a DRHVL, the leakdown rate is carefully controlled in manufacture for the purpose of controlling valve overlap variation via control of the clearance between the outer diameter of the mechanism's piston and the inner diameter of the plunger bore. Dimensional variations of these components within an acceptable tolerance range among the manufactured population of pistons and the manufactured population of plungers, result in a random distribution of leakdown rates in the population of DRHVLs and a corresponding distribution of resulting internal EGR.

Another characteristic that affects valve overlap between intake and exhaust valves, but unique to a DRHVL, is the variation in the overall assembled length (working extended length) measured between a point on the DRHVL at which the DRHVL contacts the associated cam lobe and a point on the DRHVL at which it contacts the associated pushrod end or valve stem, when the DRHVL is under valve train load imposed by the associated cam lobe and in valve operating mode (locking pin mechanism engaged). As a starting point, the actual extended length of any DRHVL in a population of DRHVLs must always be shorter than the minimum working distance between a valve stem or pushrod and the base circle portion of an associated cam lobe (minimum available length), to assure that the associated valve can close.

Components within a DRHVL controlling its working extended length and the resulting mechanical lash in the valve train include a radially-extendable locking pin disposed in the plunger member for selectively engaging or disengaging a receiving feature in the lifter body to couple and decouple the plunger to the body and hence to open or, when disengaged, to not open the associated engine valve. A tower coupled at one end to the locking pin plunger member functions at its opposite upper end as a seat for a lost-motion spring. The other end of the lost-motion spring is grounded simultaneously to the lifter body and locking pin plunger member so that, while the DRVHL is in valve-lift mode (plunger coupled to body), and on the base circle of the associated cam lobe, there is a slight clearance between the locking pin and the lower portion of the locking pin receiving feature, referred hereinafter as "G-gap". As the eccentric portion of the associated cam lobe begins to exert compressive force on the DRVHL to begin opening the associated valve, the first response in the DRVHL is to move against the spring force of the lost motion spring to move the body member upward to take up the G-gap. Thus, depending on the variation in the size of the G-gap, the opening point of the associated valve is delayed as the G-gap is taken up. Further, the total lift of the valve is reduced in proportion to the amount of movement by the body member to take up the G-gap.

The control of G-gap variability from DRVHL to DRVHL is an important characteristic of a DRHVL. Too small of a G-gap (a smaller mechanical lash) in either the intake or exhaust valve DRVHL will result in a greater working extended length and cause the associated valve to open sooner, and to have an increased lift and a later closing causing a longer overlap period and greater internal EGR. Too large of a G-gap (a larger mechanical lash) will shorten the working extended length of the DRVHL and cause the associated valve to have a delayed opening, decreased lift and to close earlier. The result is a shorter period of valve overlap and lesser internal EGR. It is important to note that, since mechanical lash is not accumulative as the lift event progresses, but instead acts over the entire lift event, variations in the G-gap of both the intake valve DRVHL and exhaust valve DRVHL will affect valve overlap and internal EGR within a cylinder and must be carefully controlled.

In order to control the size of the G-gap during assembly of each DRHVL the working extended length of the DRVHL is ascertained, and a shim is inserted from a population of shims of various thicknesses to set the desired G-gap and to bring the assembled length to within tight tolerance limits.

Two problems are presented by this approach in the prior art assembly process of DRVHLs. First, because a finite number of shim thicknesses is available, for practical reasons, the population of lifters has a residual error in actual lengths randomly distributed about a mean. Second, because leakdown rate variation in the hydraulic lash compensation mechanism of a DRVHL is not linked to, and thus occurs independently of variations in the G-gap, the total variation critical to valve lift in a population of DRVHLs is the sum of the independent variations. When DRVHLs having significantly disparate variations in leakdown and mechanical lash, and especially from the extremes of total variation, are employed in different cylinders in the same engine, the differences in valve lift, valve timing, and resulting internal EGR can result in unacceptable cylinder-to-cylinder differences leading to rough idling which is inherent in the engine and cannot be tuned out.

Further, it should be noted that, because leakdown is a time-dependent phenomenon, the tolerance to these variations increases as engine speed increases. Therefore, the troublesome manifestation resulting from a cylinder-to-cylinder variation of internal EGR occurs primarily during engine idle conditions.

What is needed in the art is a means for reducing the variation in the build characteristics of a DRVHL affecting valve lift, in a population of DRVHLs, to reduce the variation of cylinder-to-cylinder internal EGR.

It is a principal object of the present invention to reduce cylinder-to-cylinder variation in internal EGR in an engine and thereby to improve the idling characteristics of an engine.

SUMMARY OF THE INVENTION

Briefly described, valve lift and timing variation associated with a deactivation roller hydraulic valve lifter (DRHVL) can result in unacceptable valve overlap variation at idle conditions for an internal combustion engine. Two sources of valve overlap variation in a DRHVL are leakdown and mechanical lash. The total overlap variation is proportional to the sum of these two factors, and each factor has an associated tolerance. In the prior art, the two factors are independent, resulting in a total lift variation that is the sum of the two independent variations. A DRHVL assembly process in accordance with the invention includes the step of associating measured leakdown parameters with measured mechanical lash and selecting the leakdown and lash characteristics of individual DRHVL assemblies such that total length variation in the population of assembled DRHVLs is reduced without incurring costs associated with tighter manufacturing tolerances on lifter components. Since leakdown rate variation on the intake valve side does not significantly contribute to total valve overlap variation, the assembly process includes using the DRHVLs having high limit or low limit leakdown rates in intake valve positions only, where their impact on varying valve overlap is minimal.

BRIEF DESCRIPTION OF THE DRAWINGS

The present invention will now be described, by way of example, with reference to the accompanying drawings, in which.

DESCRIPTION OF THE PREFERRED EMBODIMENTS

The exemplification set out herein illustrates one preferred embodiment of the invention, in one form, and such exemplification is not to be construed as limiting the scope of the invention in any manner.

Figure 1:
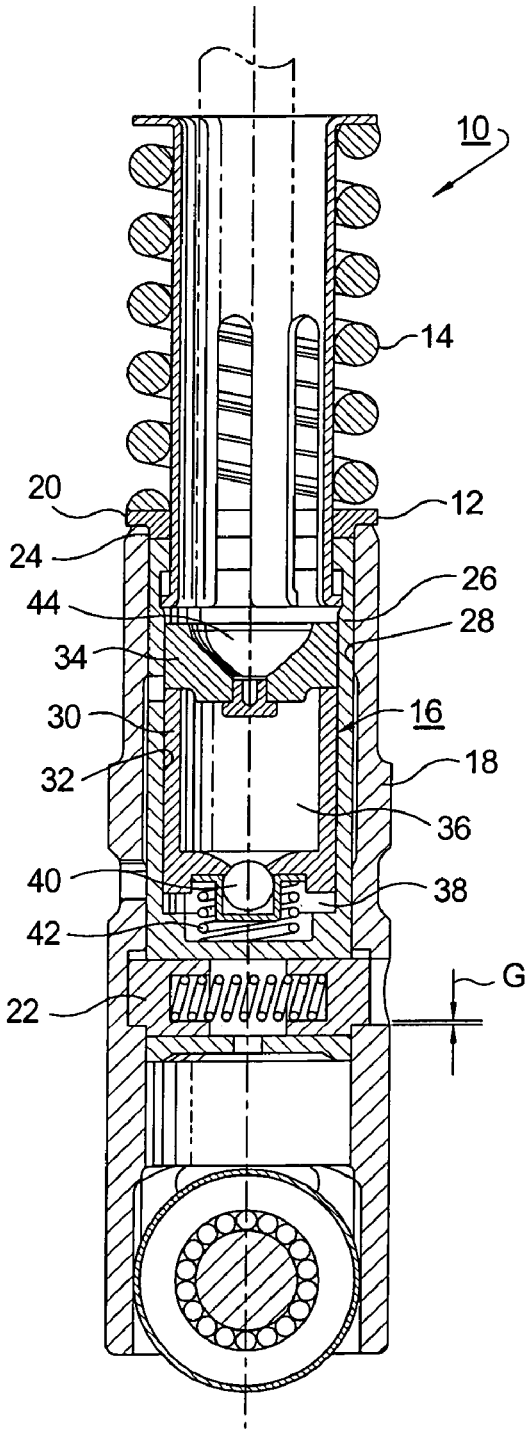
FIG. 1. (PRIOR ART)
FIG. 1 is an elevational view of a prior art deactivation hydraulic valve lifter.

Referring to FIG. 1, a prior art DRHVL 10 is shown substantially as disclosed in U.S. Pat. No. 6,814,040, and shown in FIG. 6 thereof, which patent is herein incorporated by reference. All the various components of DRHVL 10 are fully recited therein and need not all be repeated here.

Of particular interest to the discussion of the present invention is the hydraulic lash compensation mechanism 16 comprising a plunger 26 slidably disposed in a bore 28 in lifter body 18. Mechanism 16 includes a piston 30 slidably disposed in a blind bore 32 in plunger 26 and supportive of a slidable pushrod seat 34. A low pressure oil reservoir or chamber 36 is formed within piston 30. A high pressure chamber 38 is formed between piston 30 and plunger 26 in communication with low pressure chamber 36 via check valve 40. A lash spring 42 urges seat 34, via piston 30, against pushrod 44, by axially expanding chamber 38 and drawing oil from chamber 36 into chamber 38 to lengthen the DRVHL and to make it hydraulically rigid.

It is also necessary for DRVHL 10 to be able to shorten from its extended, hydraulically rigid condition, for example, as a shutdown engine cools and total mechanical lash in the valve train is reduced. Such shortening requires slow, controlled leakage of oil from high pressure chamber 38. Such leakage, known in the art as "leakdown", is provided by careful manufacturing control of the outer diameter of piston 30 and the diameter of bore 32 such that a predetermined annular clearance exists therebetween. The manufacturing intent is that the range of leakdown rates within a family of production DRVHLs be tightly controlled and relatively slow with respect to a cycle of a camshaft and valve and are therefore inconsequential during respective valve opening/closing cycles.

Figure 2:
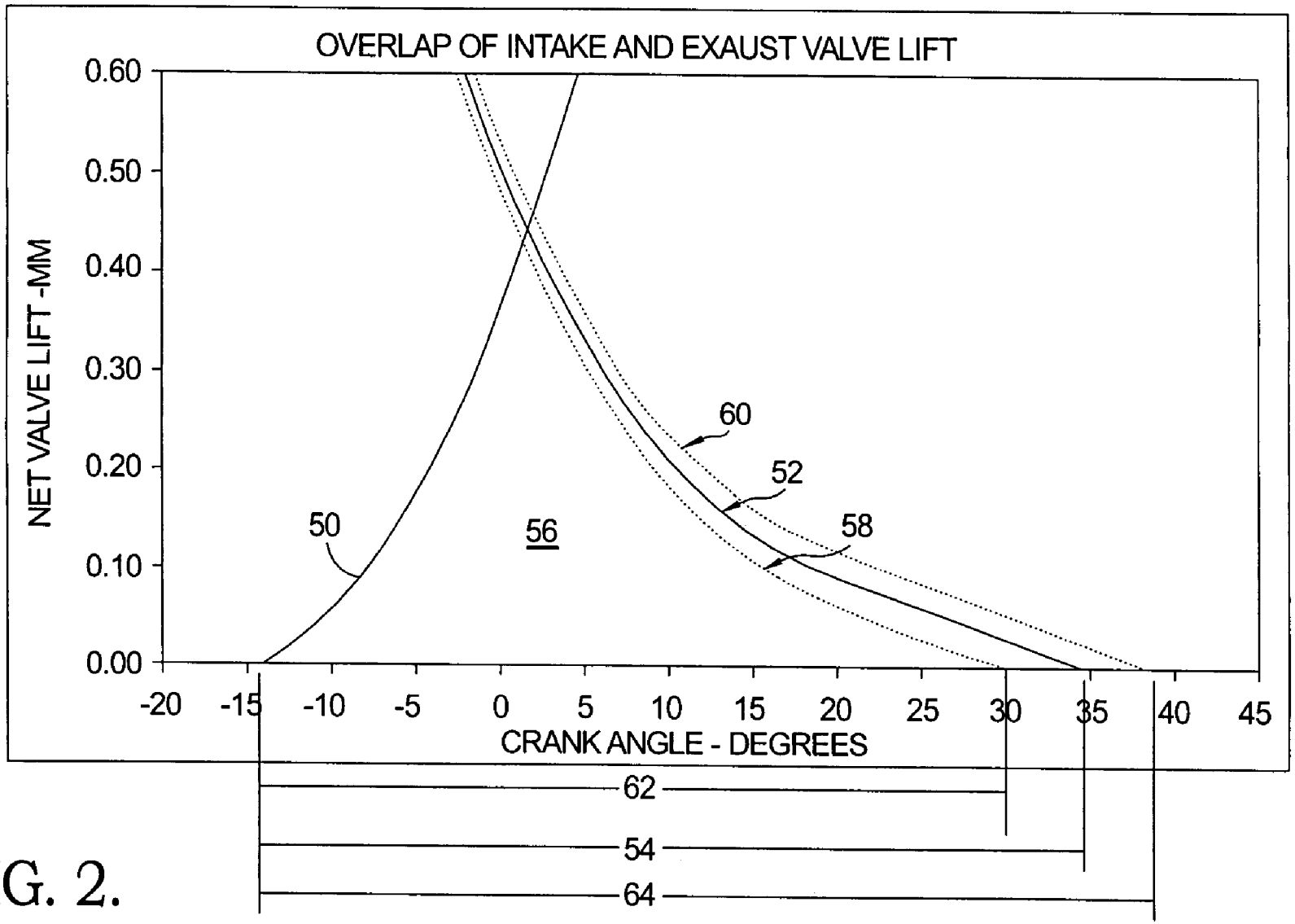
FIG. 2 is a graph showing intake and exhaust valve overlap and exhaust valve timing variations due to variations in DRVHL leakdown rates.

The leakdown rate is an important characteristic of a DRHVL because it effects valve overlap. Referring to FIG. 2, valve timing and overlap of an intake and exhaust valve within a cylinder of an exemplary engine is shown. In the exemplary engine, curve 50 represents the nominal opening event of the cylinder's intake valve wherein the intake valve begins to open at −14 crank angle degrees and continues an increased opening past 0 crank angle degrees (TDC). Curve 52 represents the closing event of the exhaust valve within the same cylinder wherein the associated DRHVL has a nominal leakdown rate. In the example shown, the exhaust valve represented by curve 52 (having a nominal leakdown rate) closes at about 35 crank angle degrees. Thus, for a rotational crank angle duration of about 49 degrees, shown as numeral 54, both the intake and exhaust valve are open and constitutes a nominal valve overlap range. Area 56 under the two curves is proportional to the amount of internal EGR resulting from the particular lifts of the intake and exhaust valves during the overlap period. Curve 58 in FIG. 2 represents the closing event of the exhaust valve wherein the associated DRHVL has a fast leakdown rate within leakdown rate tolerances; curve 60 represents the closing event of the exhaust valve wherein the associated DRHVL has a slow leakdown rate at the other tolerance extreme. It can be seen that varying the leakdown rate within the build tolerance range of a family of exhaust DRHVLs can cause the valve overlap duration to vary from a low of about 44 crank angle degrees (62) to a high of about 52 crank angle degrees (64) with a commensurate shift in the amount of internal EGR. This shift, when occurring cylinder to cylinder within an engine, can have a detrimental effect on engine idle quality. Note that, on the intake valve side (curve 50), leakdown rate variations within tolerances of the associated intake DRHVL will have a negligible effect on valve overlap since leakdown is accumulative over the duration of the lift event. That is, early in the valve lift event, minimal leakdown occurs regardless of the leakdown rate.

Also of particular interest to the discussion of the present invention is the build tolerance range of mechanical lash of a family of DRHVLs. Referring again to FIG. 1, spring seat 12 acts as both a spring seat and an axial shim for removing lash in the DRHVL. Seat 12 is a stepped washer, having an outer portion 20 of fixed thickness that acts upon lifter body 18 to transmit lost motion of the lifter body into spring 14 when locking pin 22 is in retracted mode, and having an inner portion 24 of variable axial thickness that acts as a stop and lash shim for hydraulic lash compensation mechanism 16. During assembly of the DRHVL, the dimensions of the components affecting the working extended length of the DRHVL are ascertained. A seat of proper shim thickness is selected from a population of seat shims of various thicknesses to minimize axial lash (referred to herein as "residual lash") and to set the desired height of the G-gap (FIG. 1) which facilitates the entry of locking pin 22 into the locking pin receiving feature of lifter body 18. In the prior art, lash-compensating shims are selected from a population of shims with the intent of correcting variations in manufactured lash to a common residual lash norm. The manufacturing intent is that every DRHVL be shimmed as accurately as possible to change its as-manufactured lash value to a target residual lash value.

Because the population of shims comprises a range of discrete shim thicknesses, there remains a variation in residual lash value. Variations in the residual lash value of a given DRHVL affects further the amount of valve overlap.

Figure 3:
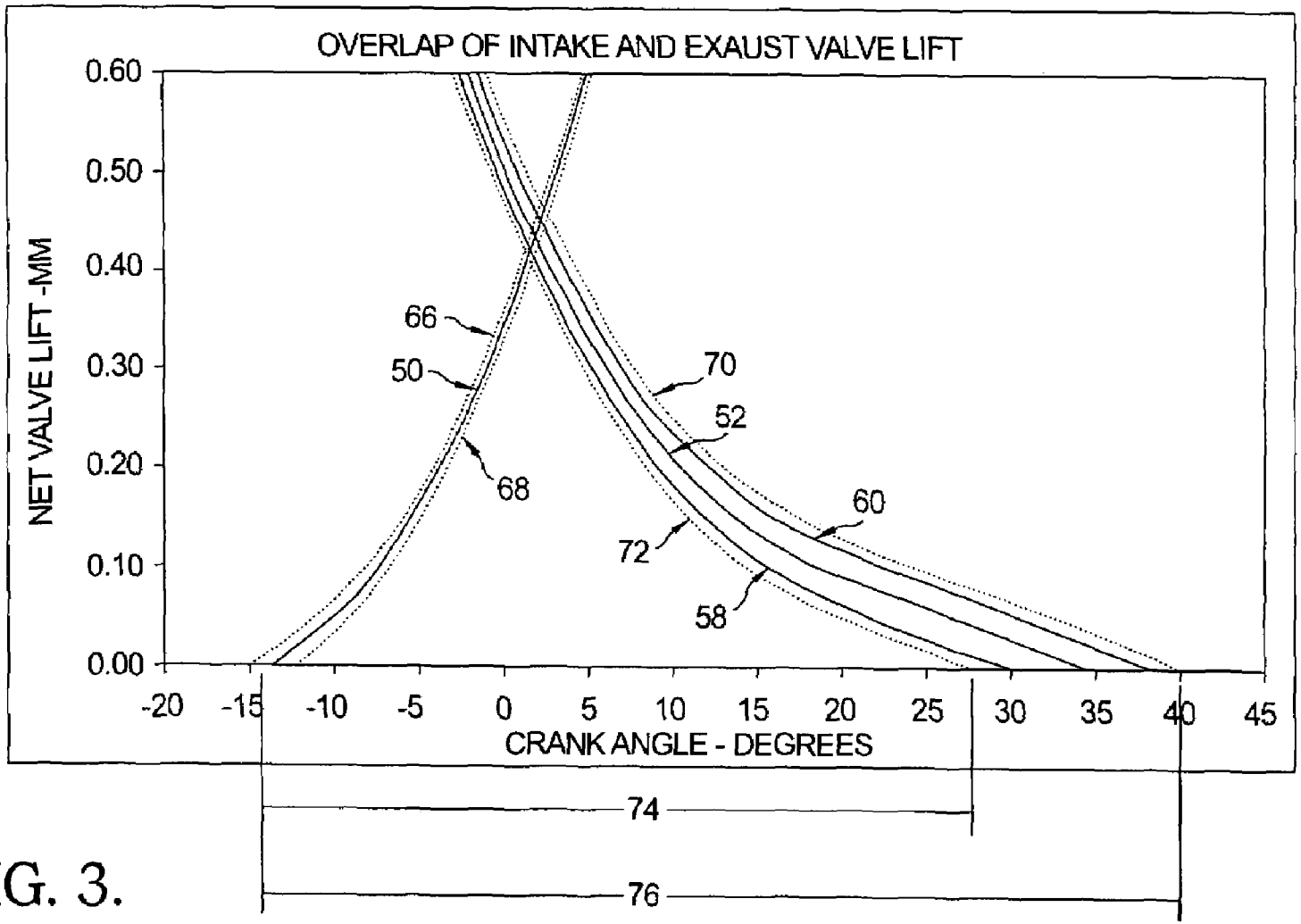
FIG. 3 is a graph showing intake and exhaust valve overlap and timing variations due to variations in DRVHL leakdown rates and mechanical lash.

Referring to FIG. 3, valve timing and overlap of an intake and exhaust valve within a cylinder of an exemplary engine are shown. As in FIG. 2, curve 50 represents the nominal opening event of the cylinder's intake valve wherein the intake valve begins to open at −14 crank angle degrees and continues an increased opening past 0 crank angle degrees (TDC). Also as in FIG. 2, curve 52 represents the closing event of the exhaust valve within the same cylinder wherein the associated DRHVL has a nominal leakdown rate. Curve 58 represents the closing event of the exhaust valve wherein the associated DRHVL has a fast leakdown rate at the tolerance extreme and curve 60 represents the closing event of the exhaust valve wherein the associated DRHVL has a slow leakdown rate at the other tolerance extreme. On the intake valve side (curve 50), variations within the mechanical lash tolerance of the associated DRHVL will have an effect on valve overlap since mechanical lash is not accumulative as the lift event progresses as was the case with leakdown, but rather acts as a constant over the entire lift event. Thus, curves 66 and 68 represent the shift in intake valve opening time wherein the associated DRHVL has either a minimum or a maximum mechanical lash within tolerance, respectively. On the exhaust valve side, curve 70 represents the additional valve closing shift caused by a DRHVL having a minimum mechanical lash within tolerance on top of the same DRHVL having a slow leakdown rate (60), within tolerance. Curve 72 represents the additional valve closing shift caused by a DRHVL having a maximum mechanical lash within tolerance on top of the same DRHVL having a fast leakdown rate (60), within tolerance. At the extreme tolerance stack-ups between the mechanical lashes of a family of exhaust valve DRHVLs (curves 66 and 68) and the mechanical lashes and leakdown rates of a family of intake valve DRHVLs (curves 70 and 72), it can be seen valve overlap durations can vary from a low of about 40 crank angle degrees (74) to a high of about 55 crank angle degrees (76) with a commensurate substantial shift in the amount of internal EGR.

Figure 4:
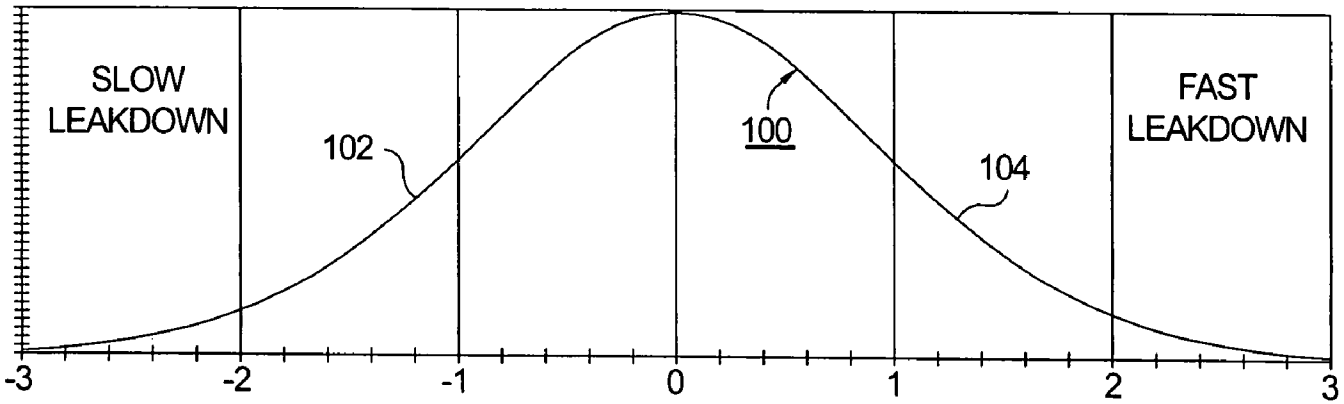
FIG. 4. (PRIOR ART)
FIG. 4 is a distribution histogram of prior art lifter leakdown axial displacement about a mean for a population of lifters.

During assembly of prior art DRHVLs, leakdown behavior and residual mechanical lash are determined individually and independently for each intake or exhaust DRHVL to ensure that each falls within the predetermined specification limits for each characteristic. Thus the manufactured population of DRVHLs exhibits a random distribution of each characteristic as shown in FIG. 4 (leakdown, curve 100) and FIG. 5 (residual lash, curve 200). For purposes of discussion below, curve 100 may be considered to have a negative limb and tail 102 representing relatively slow leakdown, and a positive limb and tail 104 representing relatively fast leakdown; and curve 200 may be considered to have a negative limb and tail 202 representing relatively small residual lash, and a positive limb and tail 204 representing relatively large residual lash.

Figure 5:
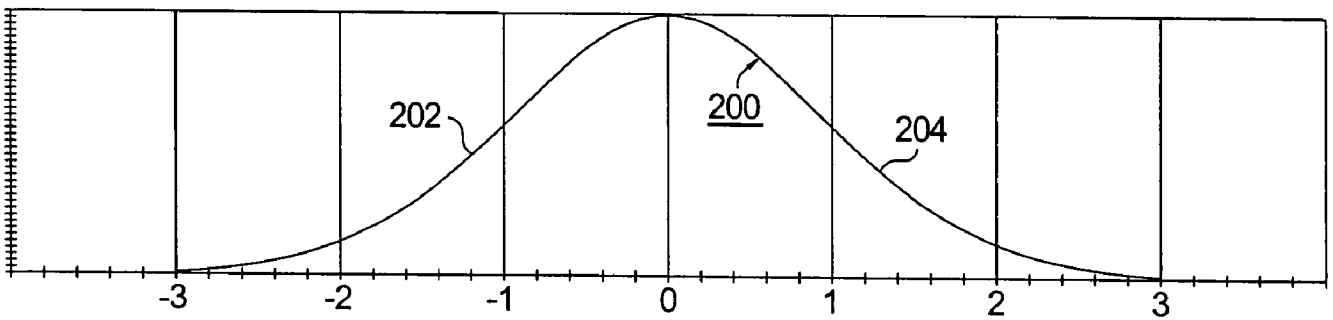
FIG. 5. (PRIOR ART)
FIG. 5 is a distribution histogram of prior art lifter mechanical lash about a mean for a population of lifters.

Because the actual population of DRVHLs shown in FIG. 4 is the same as the population of DRVHLs shown in FIG. 5, in the prior art, any leakdown performance may be mated randomly to any lash performance. This is shown schematically in FIG. 6, wherein DRVHLs may be assembled having

102/202 characteristics, 102/204 characteristics, 104/202 characteristics, or 104/204 characteristics.

It is seen that in DRVHLs combining limbs of opposite sign (102/204 and 104/202), the leakdown and lash performances tend to cancel each other, resulting in less total axial variation than would otherwise be exhibited by a DRVHL comprising only the same value of either leakdown or lash.

Figure 6:
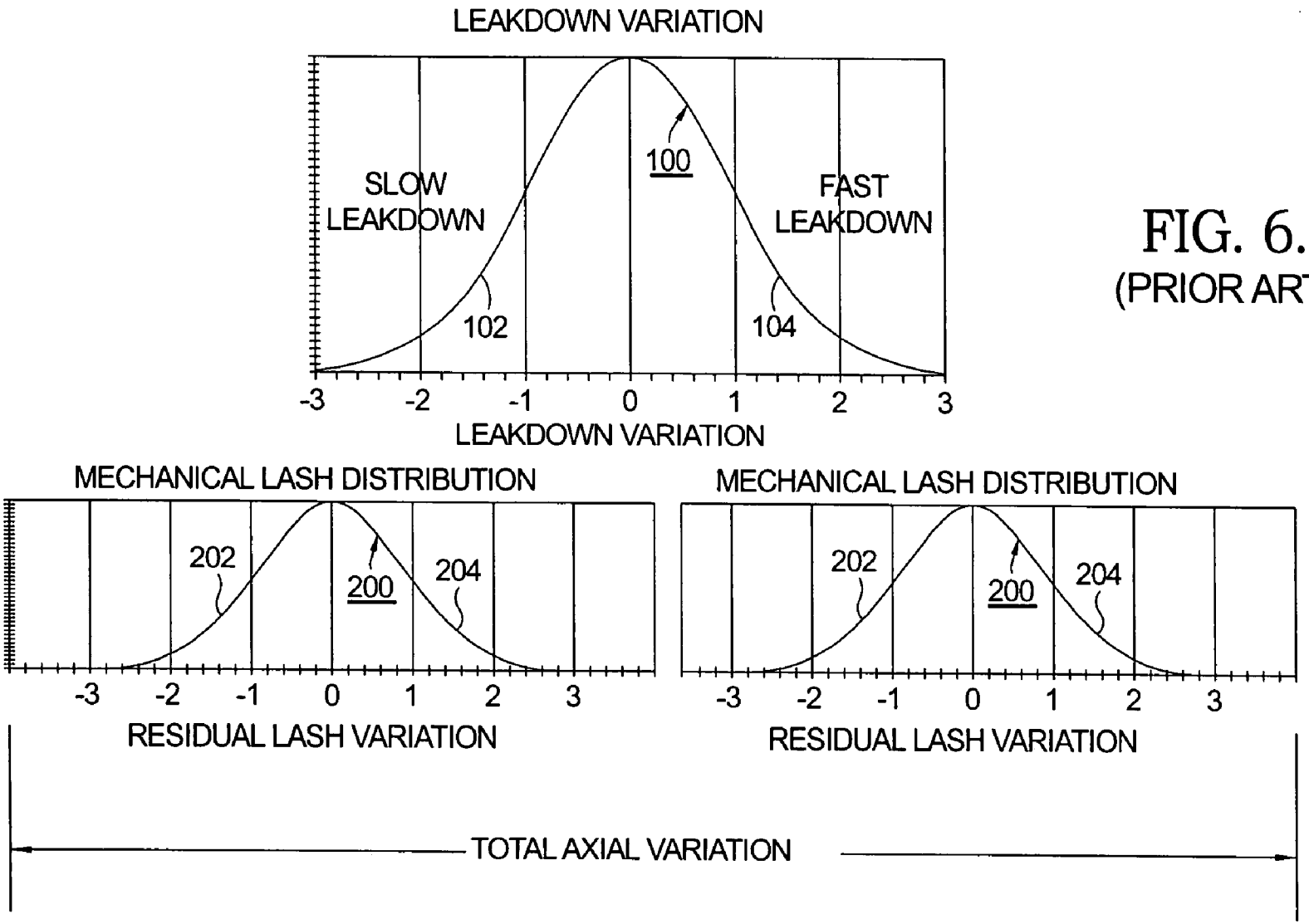
FIG. 6. (PRIOR ART)
FIG. 6 is a combination of the leakdown curve shown in FIG. 4 and the lash curve shown in FIG. 3, showing the total range of variation that can occur in the prior art (worst case variation at engine idle conditions) when the lifters in the tails of the lash curve are also the lifters in the trails of the leakdown curve.

On the other hand, in DRVHLs combining limbs of the same sign, the leakdown and lash performances tend to add to each other, resulting in greater axial variation than would otherwise be exhibited by a DRVHL comprising only the same value of either leakdown or lash. In the extremes are –/– DRVHLs having slow limit leakdown and low limit lash, and +/+ DRVHLs having fast limit leakdown and high limit lash. As shown in FIG. 6, in a prior art population of DRVHLs, although all DRVHLs are within the limits for leakdown and for lash, the population exhibits significantly greater total axial variation as compared to a conventional valve lifter.

In a method for assembly a population of DRHVLs having known population characteristics for leakdown rate and as-manufactured mechanical lash, for each DRVHL subassembly a lash-compensating shim is selected from a population of shims with the intent of providing an amount of residual lash which is not the target value but which instead will complement the known leakdown behavior of the DRVHL. Thus, total axial variation of the population can be reduced if the leakdown result for each DRVHL is utilized as part of the selection process for a complementary shim when subsequently setting the residual mechanical lash for that same DRVHL. This is a very important feature of an assembly method in accordance with the invention. For example, if it is known that a DRVHL subassembly has a leakdown time at the "fast" end of the specification (limb 104), the selection of the associated lash shim can be biased to cause the DRVHL to have relatively "small" complementary residual mechanical lash. The resulting valve lift variation of the population of final assemblies is reduced because in each fast leakdown subassembly, the loss in valve lift resulting from excessive leakdown is mitigated by a complementarily small residual mechanical lash.

Conversely, if leakdown is at the "slow" end of the specification (limb 102), the selection of the associated lash shim can be biased to cause the DRVHL to have relatively "large" mechanical lash to produce a larger complementary residual mechanical lash value (limb 204). The resulting valve lift variation of the population of final assemblies is reduced because in each slow leakdown subassembly, the increase in valve lift resulting from slow leakdown is mitigated by a complementarily large residual mechanical lash.

Assemblies having leakdown values near the nominal leakdown value are provided with shims resulting in complementary residual mechanical lash values near the nominal residual lash value.

In the assembly process, during leakdown testing, the leakdown performance category of each DRVHL subassembly is recorded in some fashion and is passed along to the lash testing step. Such recording may include, for example, scribing a leakdown category identifier as by laser marking on the DRVHL subassembly itself; identifying each DRVHL subassembly and tracking the subassemblies by hard copy or electronic means; or any other method for making the leakdown performance data for each individual subassembly available at the lash testing step. Reader means is required at the lash shim selection step to identify each subassembly for complementary selective action.

The result of complementary matching of leakdown and residual lash in each DRVHL in the population is that the variation in valve lift error in the population is significantly reduced, resulting in more uniform valve overlap within an engine and consequent smoother idling.

In the above description, leakdown testing precedes lash testing, although the reverse sequence is also fully within the scope of the invention. In the latter case, the leakdown rate is adjusted (plungers are select fit and can be biased as were the lash shims) based on the previously measured lash value.

Figure 7:
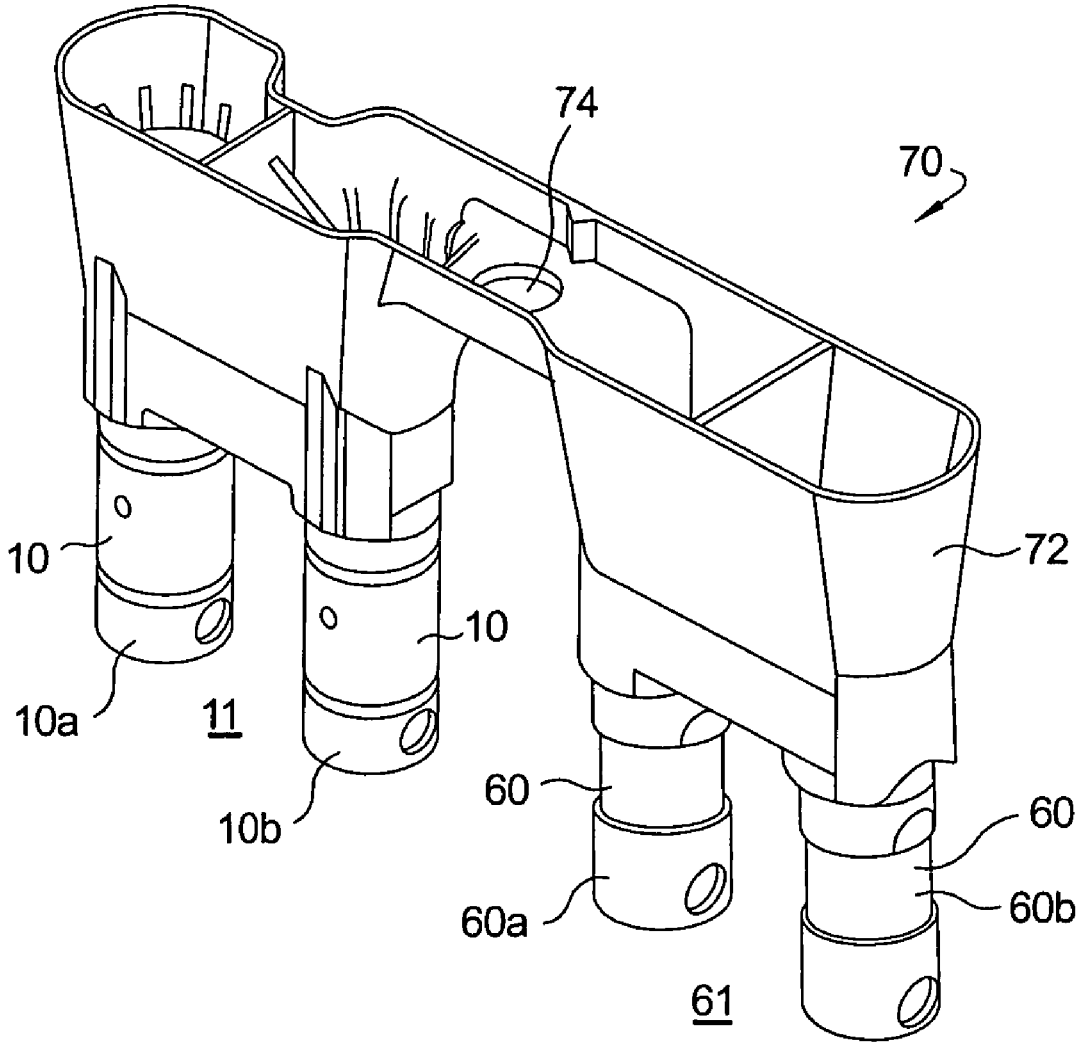
FIG. 7 is an isometric view of a kit assembly holding an array of intake and exhaust DRVHLs and conventional lifters in accordance with the invention.

Referring now to FIG. 7, prior to being assembled to an engine, DRVHLs 10 and conventional lifters 60 are packaged as kits 70 in a guide member 72, as shown. The DRVHLs, conventional lifters and guide member are then positioned proximate the appropriate cylinders in the engine block and bolted in place via bolt (not shown) and bolt hole 74. For example, in an exemplary V8 engine, Cylinder 1 (numeral 11) has deactivatable valves and the adjacent cylinder 2 (numeral 61) does not. DRVHL 10*a* is positioned over the cam shaft lobe for the intake valve of cylinder 1; DRVHL 10*b* over the cam shaft lobe for the exhaust valve of cylinder 1; conventional lifter 60*a* over the cam shaft lobe for the exhaust valve of cylinder 2 and conventional lifter 60*b* over the cam shaft lobe for the intake valve of cylinder 2. Since the leakdown rate of the hydraulic lash compensation mechanisms used on the intake valve side does not significantly contribute to valve overlap variation, in a preferred embodiment, the intake DRVHL positions in the kit can be populated with the fast and slow tails of the leakdown rate distribution, with little or no impact on varying valve overlap when installed in the engine. DRVHLs clustered around the nominal leakdown rate would be designated for and used in the exhaust valve positions. One skilled in the art could readily identify the range of leakdown rates of hydraulic lash compensation mechanisms clustered around the nominal leakdown rate for best controlling valve overlap variation when associated with the exhaust valves. Since variations in leakdown rates have the same effect on valve overlap in conventional engines not using DRVHL, this strategy of selectively using convention lifters with hydraulic lash compensation mechanisms having leakdown rates in the high and low tails in the intake valve positions only would have an equally beneficial effect on controlling the variation of valve overlap and reducing rough idles in conventional engines as well.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In a population of DRVHL subassemblies wherein each DRVHL subassembly has an ascertainable value of leakdown and a shim-corrected residual value of mechanical lash, and wherein the leakdown value and the residual lash value of each DRVHL subassembly contribute additively to a valve overlap range when the finished DRVHL is used in an internal combustion engine, and wherein the population exhibits a range of variation of engine valve overlap when a range of leakdown values is combined at random with a range of residual lash values during assembly of the individual DRVHL subassemblies in the population of DRVHL subassemblies, a method for reducing said range of variation of valve overlap comprising the steps of:

a) ascertaining a leakdown value for each DRVHL subassembly;

b) characterizing each ascertained leakdown value relative to said distribution of leakdown values for said population of subassemblies;

c) associating each subassembly with its relative leakdown value;

d) ascertaining an as-manufactured lash value for each subassembly; and e) selecting and installing in each subassembly a lash shim selected from a population of shims having various thicknesses to provide a residual lash value for each subassembly that is complementary to said leakdown value to form said finished DRVHL.

2. A method in accordance with claim 1 comprising the further step of recording individual of said relative leakdown values on respective individual of said subassemblies.

3. In a population of DRVHL subassemblies wherein each DRVHL subassembly has a hydraulic lash compensation mechanism and an ascertainable value of leakdown for said hydraulic lash compensation mechanism, and a shim-corrected residual value of mechanical lash, and wherein the leakdown value and the residual lash value of each DRVHL subassembly contribute additively to a valve overlap range when the finished DRVHL is used in an internal combustion engine, and wherein the population exhibits a range of variation of engine valve overlap when a range of leakdown values is combined at random with a range of residual lash values during assembly of the individual DRVHL subassemblies s in the population of DRVHL subassemblies, a method for reducing said range of variation of valve overlap comprising the steps of:

a) ascertaining the shim corrected residual value of mechanical lash for each subassembly;

b) characterizing each ascertained shim corrected residual value of mechanical lash relative to said normal distribution of shim corrected residual values of mechanical lash for said population of subassemblies;

c) associating each subassembly with its shim corrected residual value of mechanical lash;

d) ascertaining a leakdown value for each hydraulic lash compensation mechanism; and e) selecting and installing in each subassembly a hydraulic lash compensation mechanism having an ascertained leakdown value selected from a population of hydraulic lash compensation mechanisms that is complementary to said ascertained shim corrected residual value.

4. A method in accordance with claim 3 comprising the further step of recording individual of said relative shim corrected residual values of mechanical lash on respective individual of said subassemblies.

5. A population of deactivation roller hydraulic lash adjusters having total axial length variation resulting from a combination of variation in leakdown rate and variation in residual mechanical lash for said population, wherein said residual mechanical lash in each individual lash adjuster is biased to complement said leakdown rate in each individual lash adjuster so as to reduce the net variation of valve lift in the engine.

6. A population of DRVHL assemblies having total axial length variation resulting from a combination of variation in leakdown rate and variation in residual mechanical lash for said population, wherein said leakdown rate in each DRVHL assembly is biased to complement said residual mechanical lash in each DRVHL assembly so as to reduce the net variation of valve lift in the engine.

7. In an internal combustion engine having at least one intake valve and at least one exhaust valve and a hydraulic lash compensation mechanism associated with each valve wherein a population of said hydraulic lash mechanisms exhibits a distribution of hydraulic leakdown values within a high and low tolerance limit of said distribution, said distribution having low tolerance limit tails and high tolerance limit tails, a method of selectively mating said population of hydraulic lash compensation mechanisms to said at least one intake valve in the assembling of said internal combustion engine comprising the steps of:

a) ascertaining a leakdown value for each mechanism;

b) identifying said mechanisms having ascertained leakdown values falling in either said low tolerance limit or said high tolerance limit tails; and c) associating said identified mechanisms having ascertained leakdown values falling in either said low tolerance limit or said high tolerance limit tails with said at least one intake valve of said internal combustion engine.

8. A method in accordance with claim 7 further comprising the steps of identifying said mechanisms having ascertained leakdown values falling between said low tolerance limit and said high tolerance limit tails and associating said identified mechanisms having said ascertained leakdown values falling between said low tolerance limit and said high tolerance limit tails with said at least one exhaust valve of said internal combustion engine.

9. In an internal combustion engine having at least one intake valve and at least one exhaust valve and a hydraulic lash compensation mechanism associated with each valve wherein a population of said hydraulic lash mechanisms exhibits a distribution of hydraulic leakdown values within a high and low tolerance limit of said distribution, said distribution having low tolerance limit tails and high tolerance limit tails, a method of selectively mating said population of hydraulic lash compensation mechanisms to said at least one exhaust valve in the assembling of said internal combustion engine comprising the steps of:

a) ascertaining a leakdown value for each mechanism;

b) identifying said mechanisms having ascertained leakdown values falling between said low tolerance limit and said high tolerance limit tails; and c) associating said identified mechanisms having ascertained leakdown values falling between said low tolerance limit and said high tolerance limit tails with said at least one exhaust valve of said internal combustion engine.

* * * * *